United States Patent [19]

Schwarz et al.

[11] Patent Number: 4,810,926

[45] Date of Patent: Mar. 7, 1989

[54] IMPREGNATED THERMIONIC CATHODE

[75] Inventors: James A. Schwarz, Fayetteville; Edward J. Daniszewski, Vernon, both of N.Y.; Joseph J. Hutta, Groton, Mass.

[73] Assignee: Syracuse University, Syracuse, N.Y.

[21] Appl. No.: 72,720

[22] Filed: Jul. 13, 1987

[51] Int. Cl.[4] ..... H01J 1/14; H01J 19/06

[52] U.S. Cl. ..... 313/346 R; 313/348 DC; 252/515

[58] Field of Search ..... 313/346 R, 337, 346 DC; 252/514–515, 512–513, 520; 445/51

[56] References Cited

U.S. PATENT DOCUMENTS

| | | | |
|---|---|---|---|
| 3,134,924 | 5/1964 | Henderson et al. | 313/346 R |
| 4,019,081 | 4/1977 | Buxbaum et al. | 313/346 R |
| 4,165,473 | 8/1979 | Falce | 313/346 R |
| 4,273,683 | 6/1981 | Kawamura | 313/346 R |
| 4,275,123 | 6/1981 | Buxbaum et al. | 313/346 R |
| 4,310,777 | 1/1982 | Fukushima et al. | 313/346 R |
| 4,349,766 | 9/1982 | Ando et al. | 313/346 R |
| 4,369,392 | 1/1983 | Hotta et al. | 313/346 R |
| 4,494,035 | 1/1985 | Palluel et al. | 313/346 R |
| 4,518,890 | 5/1985 | Taguchi et al. | 313/346 R |
| 4,577,134 | 3/1986 | Clerc | 313/346 R |
| 4,675,091 | 6/1987 | Thomas et al. | 313/346 R |
| 4,675,570 | 6/1987 | Green | 313/346 R |

OTHER PUBLICATIONS

D. Norman et al., Surface Structure of Thermionic-Emission Cathodes, 58 Phys. Rev. Let. 519, Feb. 2, 1987.

*Primary Examiner*—Leo H. Boudreau
*Assistant Examiner*—Michael Razavi
*Attorney, Agent, or Firm*—Wall and Roehrig

[57] ABSTRACT

An extremely long-life, highly reproducible cathode is produced by preparing a porous sintered metal matrix, impregnating the matrix with a reagent containing a transition metal to modify the surface structure of the matrix, and then impregnating the surface-modified metal matrix with a barium-containing reagent to produce a cathode structure in which barium atoms are held in a metal-metal interaction with the transition metals and the surface of the matrix. In a preferred embodiment, the transition metal oxide is $TiO_2$. This produces a barium/transition metal oxide surface structure which permits cathode operating temperatures on the order of 650 degrees C. The barium is stable and is retained on the surface of the metal matrix, so further dispensing is not required.

10 Claims, 1 Drawing Sheet

IMPREGNATED THERMIONIC CATHODE

BACKGROUND OF THE INVENTION

This invention relates to impregnated cathodes intended for thermionic emission, and is more particularly directed to a cathode in which a body or substrate of highly porous metal (typically tungsten) is treated with a barium-containing reagent, so that barium at the surface of the metal substrate reduces the cathode work function.

Present day thermionic emitter cathodes employ a work-function-lowering mechanism to achieve high current densities at moderate operating temperatures. One such mechanism involves an electropositive monolayer absorbed onto the surface of a metallic conductor. This permits relatively high current densities, on the order of 2 amperes per square centimeter, at a moderate operating temperature on the order of 1300 K. (i.e., 1000° C.). Unfortunately, even at these operating temperatures, there is significant evaporation of the surface monolayer. To keep this evaporation from resulting in early degradation of the cathode, replenishment of the monolayer is necessary; this is typically accomplished by dispersing alkaline earth oxides within a porous metallic matrix of the cathode structure, and at operating temperatures, the impregnant "dispenses" its active element to replenish the monolayer.

Impregnated cathodes, as typified by so-called "dispenser" cathodes, comprise a tungsten matrix in which barium adheres to the surface tungsten layer. Ideally, the barium becomes vertically oriented over a surface oxygen atom on the tungsten. This forms a structure which resembles BaO. In operation, the elevated temperature of the cathode causes the barium layer to boil off. As the barium evanesces, other barium is liberated from within the matrix and rises to the surface to replace the boiled-off barium. However, to form this typical dispenser cathode, barium oxide cannot simply be mixed into a porous metal matrix. It has been found that molten barium oxide, if impregnated directly onto the tungsten, tends to poison the cathode material. Consequently, a typical dispenser cathode is formed by impressing a nickel powder and an alkaline earth carbonate, such as $CaCO_3$, together with barium carbonate into the pores of the metal matrix. The material is then heated so as to break the carbonates into oxides and evolve $CO_2$, leaving barium compounds buried within the matrix, and having a layer of BaO on the surface. Unfortunately, the continuous evolution of $CO_2$ gas in this type of dispenser cathode presents some difficulties in maintaining high vacuums within the electron tubes that employ this type of cathode. Furthermore, the dispenser cathode requires an extremely high operating temperature, i.e., 1100 degrees C. or higher, to effect the dispensing of the buried barium to the surface.

While the chemistry of a typical dispenser cathode has not been completely understood, it is thought that the operating heat creates hypothetical free barium which rises to the surface. A series of complex chemical reactions, which involve both the dispersed supporting alkaline earth oxides and the metal of the tungsten matrix, creates free barium (hypothetically) as the surface barium layer evanesces. These reactions are typically initiated at a cathode activation temperature of 1250° C. (1523 K.) and are sustained at an operating temperature of 1000° C. (1273 K.). Ideally, the captive barium would be liberated and diffuse to the surface from pores in the matrix until all the barium was depleted. However, this does not occur in real-world dispenser cathodes.

One realization that was never made previously concerning barium-tungsten dispenser cathodes was that the Ba-O-W ideal vertical structure would be a two-dimensional site group, rather than a realistic three-dimensional crystallographic point group. Consequently, the prior art could not explain failures and shortcomings of dispenser cathodes.

A number of cathodes of this type have been previous proposed. Levi et al. U.S. Pat. No. 2,700,000 relates to a barium-aluminate-treated cathode, and Levi U.S. Pat. No. 3,201,639 relates to a barium and alkaline earth oxide impregnated cathode. Falce U.S. Pat. No. 4,165,473 describes a dispenser cathode having a tungsten and iridium matrix that is impregnated with $BaAl_2O_4$. Henderson et al. U.S. Pat. No. 3,134,924 describes an oxide cathode, in which nickel and thorium oxide are dispersed within a matrix that is deposited on a metal substrate. In Toguchi et al. U.S. Pat. No. 4,518,890, an impregnated cathode is formed of scandium an aluminum oxide in a porous tungsten body impregnated with barium oxide.

All of the above-mentioned cathodes have drawbacks. All of these cathodes require barium oxide deposited on the surface, and barium oxide is volatile at typical cathode operating temperatures of 1000 degrees C. or higher. Even though replenished from within, the available barium metal is all eventually consumed. Further, far less than the optimum surface area of the cathode can be used, which leads to rather low efficiency. In the production of the dispenser cathodes, the metal matrix pores are plugged up with the barium and alkaline earth carbonate material. Filling the pores limits the surface area, and thereby limits the cathode current available for the cathode of a given diameter, as compared with the relatively larger amount of surface area that would be available if the pores were left open, by a factor of about $10^3$.

In addition, the work function for a Ba-O-W cathode surface is still somewhat high, requiring cathode operating temperatures in the range of 1000 degrees C.–1300 degrees C. These higher temperatures are also required to obtain the dispensing effect for replenishing the barium.

Previous dispenser and other impregnated cathodes are typified by patchiness of emission. That is, much of the impregnant material on the surface of the matrix occurs in massive deposits several microns thick and many microns across; these deposits tend to remain after cathode activation and block much of the surface area of the matrix. Moreover, as the cathode ages and the barium evanesces, the barium is not replaced evenly over the surface of the cathode, but tends to cluster near dispensing sites.

An ideal impregnated thermionic cathode would have the characteristics of copious electron emission, supplying an unlimited current density which, in theory, would never reach saturation, would have a low activation temperature, a low operating temperature thereby prolonging its operating life indefinitely, no loss of its key constituents during its lifetime, and be reproducible under controlled conditions so that the cathode performance is consistent and predictable. However, in state-of-the-art cathodes, current density is rather limited, activation of the cathode requires temperatures typically in excess of 1200 degrees C., operating temperatures is typically above 800 degrees C., usually much higher. The barium or barium oxide evaporation rates tend to be significant, and process conditions have been difficult to control, leading to poor reproducibility and inconsistent results from one cathode to the next.

OBJECTS AND SUMMARY OF THE INVENTION

Accordingly, it is an object of this invention to provide a thermionic cathode which avoids the drawbacks of the prior art and has performance characteristics which approach those of an ideal cathode.

It is a further object of this invention to provide a cathode characterized by a significantly increased cathode current density, a significantly reduced operating temperature, e.g., 650 degrees C. or below, and retention of its characteristics over a long lifetime.

It is another object of this invention to provide a method for making such a cathode which avoids the filling of pores in the metal matrix, and which avoids the need for high activation temperatures.

It is another object of this invention to provide a process for making a cathode in which the process steps are highly controllable and thus yield optimum reproducibility of the cathodes, so that the cathodes have consistent high quality from one to the next.

Whereas for a typical impregnated cathode, the formation of active, long-life, stable cathode structure occurs as the result of chemical reactions during activation, but not during production; in the process of this invention new solid state surface effects as well as new surface compounds are created from the beginning. Whereas previous cathode techniques have focused on the chemical and physical processes that occur in the cathode subsequent to activation, the present invention addresses the dynamic processes occurring during the formation of the matrix by using a surface modified tungsten matrix (or other equivalent highly-porous metal matrix), and new classes of impregnant compounds and reagents.

In arriving at this invention, the causal chain of steps in surface modification, activation conditions, and choice of impregnant compounds have been explored. The ultimate performance of the impregnated cathode depends critically on the ability to reproduce this sequence of steps. Consequently, the process for producing an optimum cathode requires that each step in the sequence that comprises the process be susceptible to process controls, as each step in the causal chain impacts upon both the preceding and subsequent steps, and, of course, on the operating characteristics of the cathode.

In accordance with this invention, the impregnated cathode is characterized by a high-surface-area surface-modified tungsten matrix, and strong metal-metal surface interactions are created generally over the entire surface area of the cathode matrix. The optimum compounds or reagents are employed for producing precursors of electron emission sites, and a high degree of control is obtained over the impregnation procedure. This process results in a cathode which retains its surface barium over its lifetime and does not require dispensing action, which has an extremely high cathode current density, and which has a much lower work function (and hence lower operating temperature) than existing cathodes.

The process of this invention is carried out by preparing a porous sintered metal matrix to serve as the cathode substrate, and then impregnating the matrix with a reagent that contains a transition metal. This produces a surface modified matrix in which the transition metal is bonded to surface atoms of the metal matrix in a metal-metal interaction. Thereafter, the surface-modified metal matrix is impregnated with a bariumcontaining reagent to produce a structure in which barium atoms are held in a metal-metal bond with the transition metal atoms at the surface of the matrix. Titania, (i.e., $TiO_2$) is favorably employed as the transition metal compound for impregnating the metal matrix. However, it has been found that many suitable transition metals can be employed for this, namely, Sc, Ti, V, Cr, Mn, Y, Zr, Nb, La, Hf, Ta, and Ir.

In a preferred mode, the porous sintered metal matrix is a sintered surface-modified tungsten matrix formed as follows: Equal volumes of a tungsten powder of 8–12 micron particle size and ammonium tungstate are mixed together in sufficient water to form a wet slurry, and then the slurry is calcined at 300 degrees C. to evolve ammonia gas. This is continued until $NH_3$ evolution ceases. Thereafter, the material is pressed and sintered in an argon atmosphere to form a rod or ingot, which is sliced into small wafers to serve as substrates for the cathodes.

The ammonium tungstate, when decomposed in air at elevated temperatures, produces highly porous $WO_3$, and this has an actual surface area that far exceeds the superficial or dimensional square area of the wafer. The surface area of this modified metal matrix material has an effective surface area on the order of 2.3 square meters per gram. When comparing this with the standard emission characteristics of similar unmodified B-type cathodes, the enhancement in surface area would be expected to yield a current efficiency on the order of $10^5$ amperes per gram of cathode material.

The substrate surface, including its irregularities and pores, is then treated with the transition metal compound so as to generate strong metal-metal surface interactions. For this effect, the compound of choice is titania. Titania ($TiO_2$) is a compound that forms a number of substoichiometric oxides that "wet" bulk metals because of interactions that produce surface-metal titanates. This can be explained in simple terms by stating that the oxygen of the titania links to valence electron orbitals of the substrate metal and yields a rather stable metal-metal bonding. The function of titania in this invention is to establish a surface template that facilitates the dispersal of barium atoms on the cathode surface to form small, uniformly-distributed metal clusters or crystallites. In the ideal cathode, the individual barium atoms are uniformly distributed over the entire surface of the substrate, and are lodged in with the $TiO_2$. These metal clusters act as the sources of enhanced thermionic emission on the previously-prepared high surface area metal matrix.

In previous cathodes, as mentioned previously, the barium has been generated from carbonate, and barium carbonate has been the traditional compound of choice in impregnated cathodes. Other barium-containing reagents had not been considered. However, the inventors herein have found that barium nitrate, $Ba(NO_3)_2$ has distinct advantages over $BaCO_3$. In the first place, the decomposition temperature for barium nitrate is lower than for barium carbonate. Provided there are suitable interaction sites on the modified metal matrix surface to strongly interact with elemental barium, the nitrate compound offers the advantage of lower activation temperatures. The applicants have found that the activation temperature for creating solid-state interactions are reduced more than 200 degrees C. when barium nitrate is used as the impregnant, rather than barium carbonate. Also, the use of nitrate avoids the problem of carbon dioxide gas production during operation, as mentioned above. In addition to $Ba(NO_3)_2$, other barium reagents could be used.

One key realization that resulted in this invention was that a three-dimensional crystallographic point group involving the tungsten substrate and barium monolayer was required to bring about high stability and reduced operating temperatures. Consequently, the process of this invention is seen to be beneficial because it stabilizes the barium monolayer, so there is no need for "dispensing". The means for bringing about this stabilization is the CONTROLLED formation of a strong metal-metal bond (SMMB). However, the choice of starting materials conflicts with the conventional notion that cathode materials must be high temperature performers, for the use of conventional cathode materials precludes uniform formation of SMMB. It is this factor, wherein good SMMB is the objective of fabrication, that resulted in the reduced-operating-temperature cathode with good thermionic emission characteristics. Mossbauer analysis of good conventional cathodes yielded the desired surface site group structure; differential thermal analysis fingerprinted the fabrication sequence; and heterogenous supported catalysis theory and techniques pointed out which starting reagents should be used.

The following procedures were employed to produce cathodes according to this invention.

First the tungsten/tungsten oxide ingot is cut to wafers of 0.316 $CM^2$ superficial area. These wafers are impregnated in a saturated solution of $TiO_2$ for a period of one hour, and thereafter dried in a helium atmosphere. Then, the treated wafers are impregnated, using a wet impregnation technique, with $Ba(NO_3)_2$ and/or $H_2IrCl_6$. After impregnation, the wafers are allowed to dry overnight in a helium atmosphere. The dried, treated, and impregnated wafers are then placed in an evacuated chamber and activated for one hour at a temperature of 600 degrees C.

Cathodes produced in this fashion were tested at a range of temperatures well below the conventional operating temperatures, and in particular between about 525 degrees C. and 625 degrees C., with a nominal anode voltage of 10 volts. An electron emission current of 500 milliamps was obtained at 625 degrees C., which translates to a current density on the order of 1.58 amperes per square centimeter.

Three types of cathodes were produced, as described below, namely Cathode I in which the modified tungsten/tungsten oxide matrix is impregnated with barium nitrate; Cathode II in which the modified matrix was impregnated with titania and with barium nitrate; and Cathode III in which the modified matrix was impregnated wih chloroiridic acid and then barium nitrate.

DESCRIPTION OF THE PREFERRED EMBODIMENT

Figure 1:
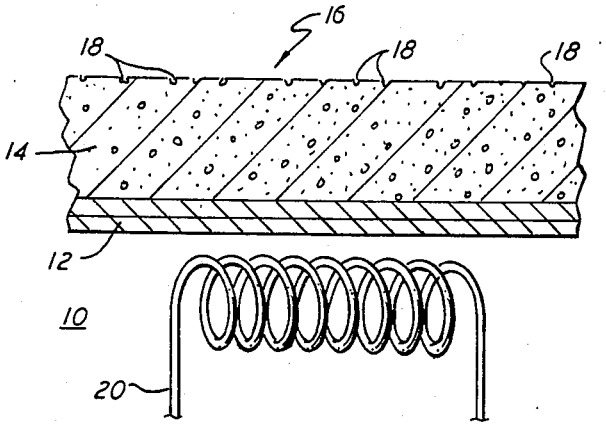
FIG. 1 is a cross sectional schematic view of an impregnated cathode according to the present invention.

In FIG. 1, the general structure of a cathode 10 of this invention is illustrated schematically. In this cathode 10 a support plate 12 supports, and carries cathode current to, a W and $WO_3$ sintered metal matrix 14. This metal matrix is highly porous, and an extremely irregular upper surface 16 increases its effective surface area many fold over its superficial or dimensional surface area. The matrix 14 contains voids 18 that open to the surface 16. A heater or filament 20 is disposed beneath the support plate 12, and serves for heating the cathode 10 to its operating temperature.

Figure 2:
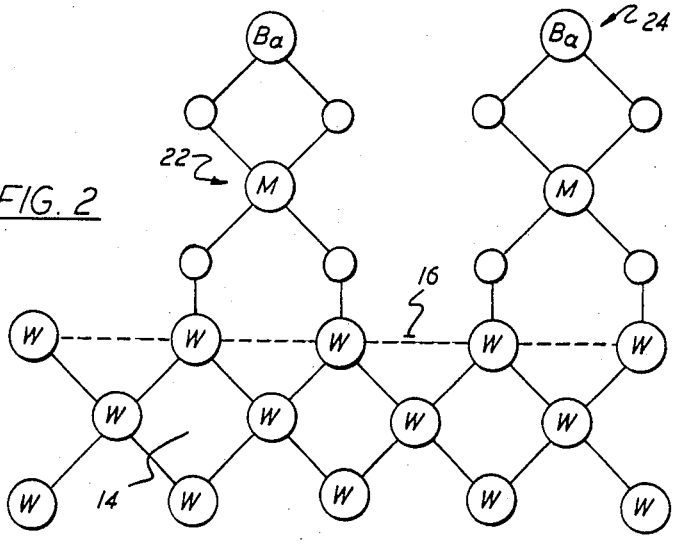
FIG. 2 is a schematic diagram showing the atomic surface structure of the cathode of a preferred embodiment.

As shown in FIG. 2, the crystallographic structure at the surface 16 of the modified metal sintered substrate 14 is characterized by transition-metal-oxide molecules 22 that link to oxygen atoms on the surface oxide formed on tungsten atoms of the matrix 14. In the preferred embodiment, the transition metal M is titanium Ti. Above the transition metal oxide layer 22, a barium layer 24 has barium atoms which bond with the two oxygen atoms of the titania $TiO_2$. Notably, the barium Ba forms a strong metal/metal bond with the transition metal M, and shares two of the oxygen atoms. This is to be contrasted with the BaO structure that is typical in conventional impregnated and/or dispenser cathodes. The structure of this invention is much more stable at elevated temperatures and the metal/metal bonded Ba will not boil away as does BaO. Therefore, no dispensing action is required over the lifetime of the cathode.

Moreover, the Ba-$TiO_2$-W structure has a very low work function, and therefore requires much lower operating temperatures for the emission of electrons than do conventional cathodes. This lower operating temperature itself results in a lower volatility in the barium, which additionally yields a longer cathode lifetime.

Furthermore, because the pores or voids 18 are left open and not blocked, the pores themselves provide a multitude of additional electron emission sites. The barium spreads out over the entire irregular surface, and thus the effective area is greater than with conventional cathodes, typically by a factor of $10^4$.

It has been discovered and shown, for example by a Mossbauer probe technique, that the transition metal oxide and barium at the surface of the modified matrix form a stable crystallographic structure, more particularly, a structure identical with $BaTiO_3$ hexagonal close-pack crystal structure.

Figure 3:
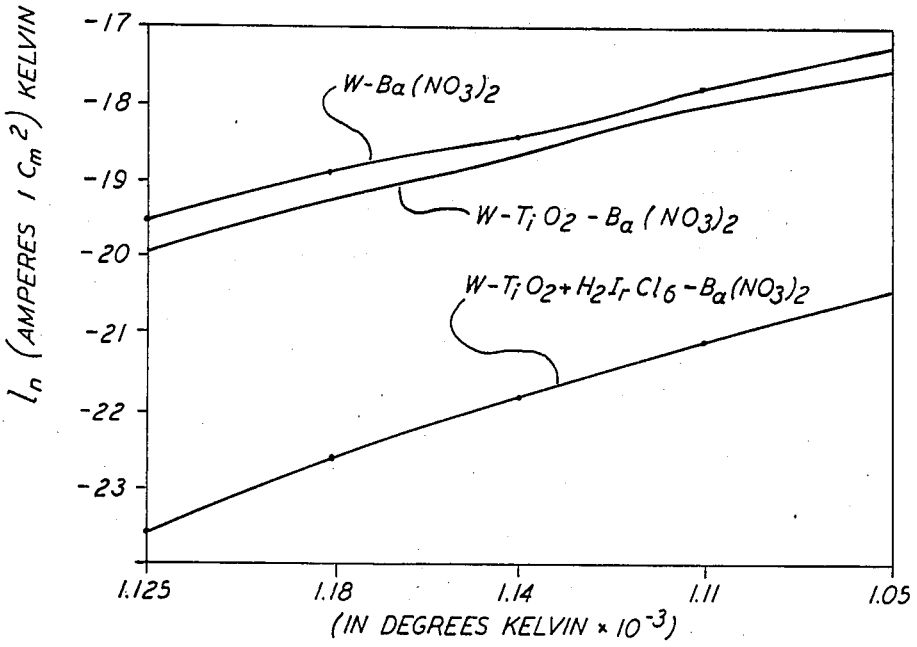
FIG. 3 is a chart showing zero field saturated current density for impregnated cathodes according to this invention.

The chart of FIG. 3 shows the temperature performance characteristics of three examples of cathodes produced according to this invention. Cathode I was formed of the modified matrix impregnated with $Ba(NO_3)_2$; Cathode II was constructed of the modified metal matrix impregnated with $TiO_2$ and $Ba(NO_3)_2$; Cathode III was formed of the modified metal matrix impregnated with $H_2IrCl_6$, and then further impregnated with $Ba(NO_3)_2$.

In FIG. 3, the logarithm of current over temperature squared is plotted against inverse temperature. The slope of these straight plots are related directly to the work function according to Richardson's equation, which basically states that current density is proportional to the exponential of minus one times the work function divided by the product of the absolute temperature times Boltzman's constant, where the constant of proportionality is a universal constant. The work functions for these three cathodes were then calculated, with the results as shown in the following table.

| Cathode | Work Function |
|---|---|
| I | 2.1 EV |
| II | 1.5 EV |
| III | 1.2 EV |

It should be recognized that these work functions are extremely low as compared to state-of-the art cathodes.

In summary, the cathodes prepared according to this invention have the twin advantages of extremely high effective surface area, yielding a high cathode efficiency, and low work function which permits operation at relatively cool temperatures. Also, because of the stable surface barium structure, the cathodes have extremely long lives and are highly suited for use where longevity is an absolute requirement. Also, because of the simplicity of maintaining control over the production processes, the cathodes produced according to this invention are extremely consistent and highly reproducible.

In Cathode III, the chloroiridic acid replaces the titanium oxide, as the latter is insoluble, although it is also possible to use water soluble titanium reagents. However, iridium appears to form a better strong metal-metal bond with barium than does titanium, and there is evidence that a betteryet SMMB results if osmium is used.

While the invention has been described in detail with reference to certain preferred embodiments, it should be recognized that the invention is not limited to those precise embodiments and that many modifications and variations would present themselves to those with skill in the art without departing from the scope and spirit of this invention, as definded in the appended claims.

What is claimed is:

1. Process for forming a stable impregnated cathode comprising a. Preparing a highly porous sintered metal matrix that consists of tungsten and tungsten oxide; wherein the step of preparing the sintered tungsten and tungsten oxide substrate is carried out by mixing pulverized tungsten metal and ammonium tungstate in an aqueous slurry; calcining the slurry at an elevated temperature to evolve ammonia; and pressing and sintering the calcined slurry in an inert atmosphere;

b. Impregnating said matrix with a reagent containing a transition metal to produce a surface-modified matrix in which the transition metal is bonded to surface atoms of the tungsten oxide of said metal matrix; and c. Impregnating the surface-modified metal matrix with a barium-containing reagent to produce a structure in which barium atoms are held in a metal-metal bond with said transition metal atoms at the surface of said matrix.

2. Process for forming a stable impregnated cathode according to claim 1 wherein said impregnating the matrix with a transition metal reagent includes contacting the matrix with titanium oxide.

3. Process for forming a stable impregnated cathode according to claim 1 wherein the transition metal is selected from a group that consists of Sc, Ti, V, Cr, Mn, Y, Zr, Nb, La, Hf, Ta, and Ir.

4. Process for forming a stable impregnated cathode according to claim 1 wherein said barium-containing reagent includes barium nitrate.

5. Process for forming a stable impregnated cathode according to claim 4 wherein said barium-containing reagent also includes chloroiridic acid.

6. Process for forming a stable impregnated cathode according to claim 6 wherein the step of impregnating the surface-modified metal matrix with a barium-containing reagent is carried out by contacting the matrix with an aqueous solution of said barium nitrate followed by drying the matrix in an inert gas atmosphere.

7. A stable impregnated cathode comprising a highly porous sintered metal matrix having an effective surface area of at least 2.3 square meters per gram formed as a substrate of tungsten and tungsten oxide, a transition metal oxide bonding with surface atoms of the tungsten oxide of the metal matrix, and barium forming metal-metal bonds with the transition metal oxide wherein each barium atom is linked to two oxygen atoms of the transition metal oxide to form a cathode structure with a low electron emission work function and with an increased effective area.

8. A stable impregnated cathode as in claim 7 wherein said transition metal oxide is an oxide of one or more of the transition metals selected from the group that consists of Sc, Ti, V, Cr, Mn, Y, Zr, Nb, La, Hf, Ta, and Ir.

9. A stable impregnated cathode as in claim 7 wherein the barium and transition metal oxide at the surface of the metal matrix form a hexagonal close pack structure.

10. A stable impregnated cathode as in claim 7 wherein said transition metal oxide is titanium oxide and the barium and titanium oxide at the surface of the metal matrix form a hexagonal $BaTiO_3$ structure.

* * * * *